US006864870B2

(12) United States Patent
Kim et al.

(10) Patent No.: US 6,864,870 B2
(45) Date of Patent: Mar. 8, 2005

(54) LIQUID CRYSTAL DISPLAY CONTROLLER WITH IMPROVED DITHERING AND FRAME RATE CONTROL AND METHOD THEREOF

(75) Inventors: Hong-Kyu Kim, Yongin-shi (KR); Kyung-Mook Lim, Yongin-shi (KR)

(73) Assignee: Samsung Electronics Co., Ltd. (KR)

( * ) Notice: Subject to any disclaimer, the term of this patent is extended or adjusted under 35 U.S.C. 154(b) by 308 days.

(21) Appl. No.: 09/894,062

(22) Filed: Jun. 28, 2001

(65) Prior Publication Data

US 2003/0030611 A1 Feb. 13, 2003

(30) Foreign Application Priority Data

Mar. 28, 2001 (KR) ..... 2001-16193

(51) Int. Cl.[7] ..... G09G 3/36

(52) U.S. Cl. ..... 345/89; 345/83; 345/87; 345/88; 345/596; 345/600

(58) Field of Search ..... 345/87, 88, 89, 345/596, 600, 605, 83, 147, 153, 90

(56) References Cited

U.S. PATENT DOCUMENTS 4,819,190 A * 4/1989 Hinman et al. ..... 345/418
5,485,558 A * 1/1996 Weise et al. ..... 345/597
5,638,187 A * 6/1997 Cariffe ..... 358/3.17
5,805,305 A * 9/1998 Abe ..... 358/3.13
6,198,469 B1 * 3/2001 Tjandrasuwita ..... 345/690
6,226,054 B1 * 5/2001 Morgan et al. ..... 348/759
6,288,698 B1 * 9/2001 Ishii et al. ..... 345/87
6,348,909 B1 * 2/2002 Kim ..... 345/89

* cited by examiner

*Primary Examiner*—Regina Liang
*Assistant Examiner*—Kimnhung Nguyen
(74) *Attorney, Agent, or Firm*—F. Chau & Associates, LLC

(57) ABSTRACT

Disclosed is a liquid crystal display (LCD) controller with improved dithering and frame rate control to reduce the physical (hardware) cost and power consumption, and a method thereof. The LCD controller utilizes a mechanism of minimizing a size of a dithering pattern register which stores plural gray levels. A duty cycle value for the respective gray levels is determined by using the same bit number as denominator values of the plural gray levels. The LCD controller includes a dithering pattern register section for storing the plural gray levels, modular register counters for performing counting operation to determine a binary value of most significant bit of the respective gray levels, multiplexers for generating data patterns for the respective gray levels in accordance with an output of the respective modular register counters; and a selection means for selecting and generating a corresponding bit of a data pattern corresponding to pixel data provided on a LCD panel.

15 Claims, 4 Drawing Sheets

| Fig. 2A | Fig. 2B |
|---|---|

LIQUID CRYSTAL DISPLAY CONTROLLER WITH IMPROVED DITHERING AND FRAME RATE CONTROL AND METHOD THEREOF

This application relies for priority upon Korean Patent Application No. 2001-016193, filed on Mar. 28, 2001, the contents of which reference in their entirety.

FIELD OF THE INVENTION

The present invention generally relates to a liquid crystal display (LCD) controller and, more specifically, to a LCD controller for improving dithering and frame rate control in LCD devices.

BACKGROUND OF THE INVENTION

FIG. 1 shows a general scheme of a liquid crystal display (LCD) device for displaying pictures thereon. Referring to FIG. 1, a general function of an LCD controller 14 is transferring contents of a video buffer embedded in a frame memory (or system memory) 12 to a LCD device 16. The LCD device 16 includes a gate driver and a source driver for driving LCD panels, and the LCD controller 14 generates signals to control the drivers. The control signals provided from the LCD controller 14 are generally divided into two types, i.e. clock signals such as pixel clock, line clock, and frame clock for synchronization between two modules, and data signals required for providing picture data to be displayed on LCD panels. In general, the data signals are formed of 4-bit, 8-bit, or 16-bit, which allows a bandwidth of data transferred to a LCD driver to be large.

Further, the LCD controller 14 supports not only white and black mode but also gray levels by use of a dither and frame rate control block. The dither and frame rate control block is used for expressing gray level values as binary data. Suppose that gray level values for 4 gray levels are "0, ⅓, ⅔ and 1", binary data transferred to the LCD device is "0" or "1". For the purpose of expressing the gray level values such as "⅓" and "⅔", binary data is transferred in a certain number of frames such that "0" in a first frame, "1" in a second frame, and "0" in a third frame are respectively transferred. As a result, the transferred data value is "010", which results in making a duty cycle to be "⅓" which expresses the gray level of "⅓".

In general, the dither and frame rate control block includes dithering pattern registers to store gray level values and a control unit to control drawing a value for a frame from the registers. However, conventional LCD controllers have more dithering pattern registers than needed to store required gray level values. Specifically, the conventional dithering pattern registers are configured as a 4-bit unit to synchronously provide four (4) pixel values. Such a configuration of the dithering pattern registers forms 4-bit dithering pattern as much as a denominator value to express dithering pattern values for plural gray levels. That is, assuming that a denominator value of a predetermined gray level is "7", bit length of the dithering pattern registers is 28 (=4×7) bits. If a denominator value of a predetermined gray level is "5", bit length of the dithering pattern registers is 20 (=4×5) bits. Dithering pattern values of the dithering pattern registers are programmed to have a value as much as a required duty cycle in one bit length. For instance, if the gray level is "⅐", the dithering pattern value of a corresponding dithering pattern register is programmed to assign "1" to 4 bits and "0" to the rest (24 bits) of the total 28 bits.

Respective dithering pattern values for 16 gray levels dithered by the foregoing manner are as follows:

⅙: 0111 1111 1101 1111 1011 1111 1110
⅘: 0111 1110 1011 1101 1111
⅚: 0111 1011 1110 0101 1101 1011 1110
¾: 0111 1101 1011 1110
⅔: 1101 0110 1011
⅗: 0101 1010 0101 1011 1110
⅘: 1011 0101 1010 0101 1010 0101 1110
½: 1010 0101 1010 0101
⅗: 0100 1010 0101 1010 0101 1010 0001
⅖: 1010 0101 1010 0100 0001
⅓: 0010 1001 0100
¼: 1000 0010 0100 0001
⅕: 1000 0001 0100 0010 0000
⅐: 1000 0000 0010 0000 0100 0000 0001

Thus, the size of the total dithering pattern values in the dithering pattern registers is 292 (=7×4×5+5×4×4+4×4×3+3×4×2) bits. Since circuitry for one bit is made of a flip-flop, the hardware cost for the conventional dithering pattern registers increases due to the large size of the dithering pattern value data. In addition, power consumption of the dithering pattern registers also increases.

Moreover, in the conventional LCD controller, only one nibble is continuously supplied through one line among the respective bit patterns. Assuming that all of a first line of a frame have gray level values of "⅐", a specific nibble of the dithering pattern values for the gray level "⅐" is continuously provided. If only a first nibble of the dithering pattern values for the gray level "⅐" is selected, data "1000" is always provided in the line. It is temporally possible to make the dithering pattern value for the gray level "⅐", but the data "1000" is spatially reiterative in one line. This also occurs in the case of providing the dithering pattern value for the gray level "¼".

SUMMARY OF THE INVENTION

It is an object of the present invention to provide a liquid crystal display (LCD) controller having a circuit configuration capable of minimizing power consumption and hardware cost.

It is another object of the present invention to provide a method for realizing a LCD controller having a circuit configuration capable of minimizing power consumption and hardware cost.

In order to attain the above objects, according to an aspect of the present invention, there is provided a LCD controller including a dithering pattern register section, a plurality of modular register counters, a plurality of multiplexers, and a selection means.

The dithering pattern register section forms dithering pattern of binary data values for a plurality of gray levels using the same number as denominator values of the gray levels, and stores dithering pattern values for the gray levels having the same denominator value by grouping the same. The plurality of modular register counters perform counting operation to determine a binary value of most significant bit of the respective gray levels in synchronization with a frame clock, a line clock, and a pixel clock. The plurality of multiplexers generate data patterns for the gray levels in accordance with an output of the respective modular register counters. The selection means selects and generates a corresponding bit of the data pattern corresponding to a pixel data provided on a LCD panel among the data patterns.

Each of the modular register counters includes a modular frame counter, a modular line counter, a modular pixel counter, a next frame count generating means, a next line counter, a first multiplexer, a next pixel counter, and a second multiplexer. The modular frame counter performs counting operation whenever frame is changed by synchronously responding to the frame clock. The modular line counter performs counting operation whenever line is changed by synchronously responding to the line clock. The modular pixel counter performs counting operation whenever pixel is changed by synchronously responding to the pixel clock. The next frame counter generates a first update value to the modular frame counter in response to an output signal of the modular frame counter so that a current value in the modular frame counter is updated whenever the frame is changed. The next line counter generates a second update value in response to an output signal of the modular line counter. The first multiplexer selectively generates an initial value of the modular frame counter whenever the frame is changed or the second update value provided from the next line counter whenever the line is changed to the modular line counter in response to a first selection signal. The next pixel counter generates a third update value whenever the pixel is changed in response to an output signal of the modular pixel counter. The second multiplexer selectively generates the initial value of the modular frame counter whenever the frame is changed, an initial value of the modular line counter whenever the line is changed, and the third update value provided from the next pixel counter whenever the pixel is changed to the modular pixel counter in response to a second selection signal. The next frame counter increases the first update value whenever the frame is changed. The next frame counter increase the second update value whenever the line is changed. The next pixel counter increases the third update value whenever the pixel is changed.

According to another aspect of this invention, there is provided a method for performing a dithering and frame rate control in a liquid crystal display controller generating control signals for displaying in response to pixel data to display pictures on a liquid crystal panel having a plurality of pixels. The method preferably includes storing binary data of gray levels in dithering pattern registers using a same bit number as denominator values of the gray levels; performing counting operation to determine a binary value of most significant bit of the respective gray levels; generating data patterns for the gray levels based on the binary value of most significant bit; and selecting and generating a corresponding bit of a data pattern corresponding to the pixel data.

The step of performing counting operation may include performing counting operation whenever a frame is changed in response to a frame clock; performing counting operation whenever a line of the frame is changed in response to a line clock; performing counting operation whenever a pixel of the line is changed in response to a pixel clock; providing a first update value whenever the frame is changed to update a current value for the counting operation in response to the frame clock; providing a second update value whenever the line is changed in response to a result of the counting operation in response to the line clock; selectively providing an initial value for the counting operation in response to the frame clock or the second update value, to update a current value for the counting operation in response to the line clock; providing a third update value in response to a result of the counting operation in response to the pixel clock whenever the pixel is changed; and selectively providing the initial value for the counting operation in response to the frame clock, an initial value for the counting operation in response to the line clock, or the third update value, to update a current value for the counting operation in response to the pixel clock.

According to the device and the method of the invention, the LCD controller is realized to have a dither and frame rate control block capable of storing plural gray levels without increasing the size of the dithering pattern registers.

The foregoing features and advantages of the present invention will be more fully described in the accompanying drawings.

BRIEF DESCRIPTION OF THE DRAWINGS

The above and other objects, features and advantages of the present invention will become more apparent from the following detailed description when taken in conjunction with the accompanying drawings in which.

DESCRIPTION OF PREFERRED EMBODIMENTS

It should be understood that the description of preferred embodiments is merely illustrative and not taken in a limiting sense. In the following detailed description, several specific details are set forth in order to provide a thorough understanding of the present invention. It will be obvious, however, to one skilled in the art that the present invention may be practiced without these specific details.

To describe preferred embodiments of the present invention, there is provided a liquid crystal display (LCD) controller where 16 gray levels are supported and 4 pixel values are synchronously generated.

Figure 1:
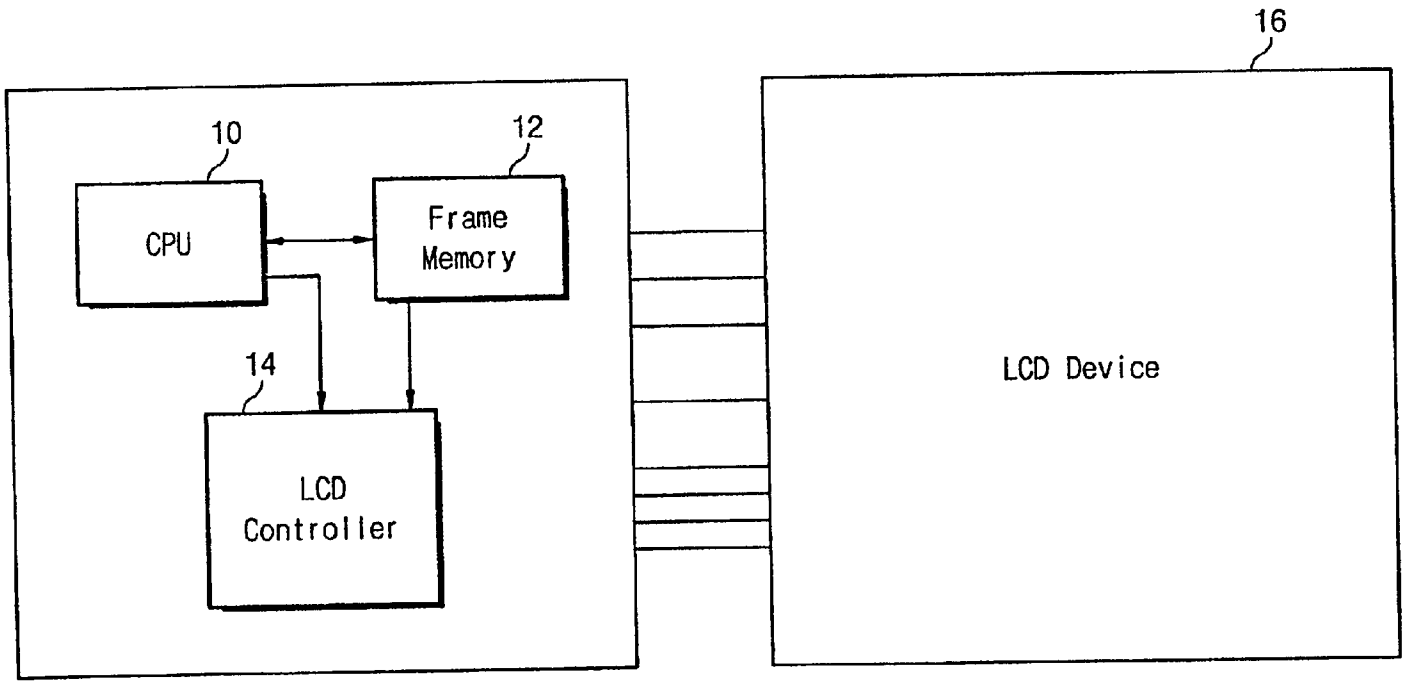
Fig. 1 (Prior Art)
FIG. 1 is a block diagram illustrating a general scheme of liquid crystal display (LCD) device and controller.
Figures 2, 2A:
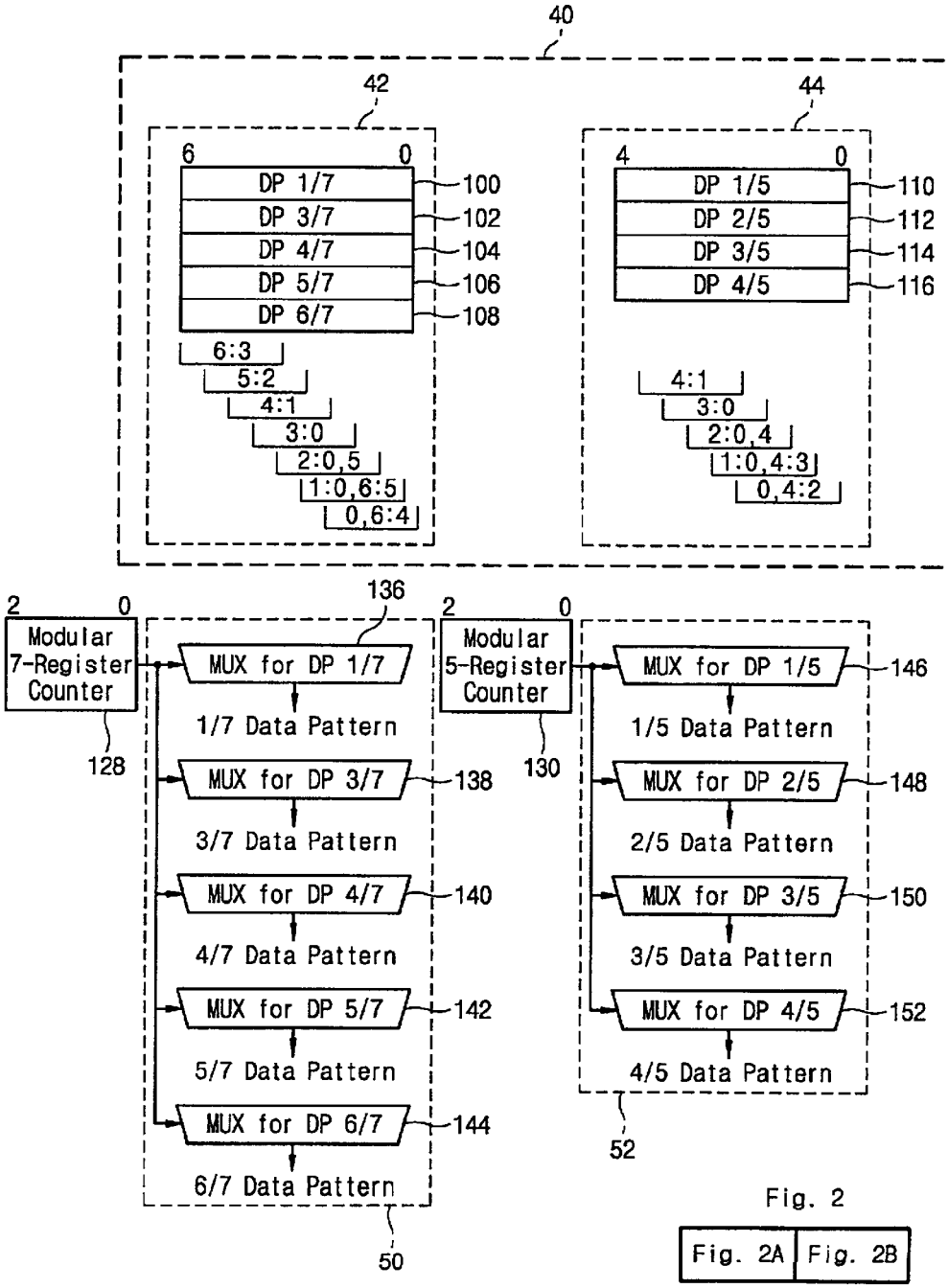
FIGS. 2A and 2B show a block diagram of a dither and frame rate control block in a LCD controller according to a preferred embodiment of the present invention.
Figure 2B:
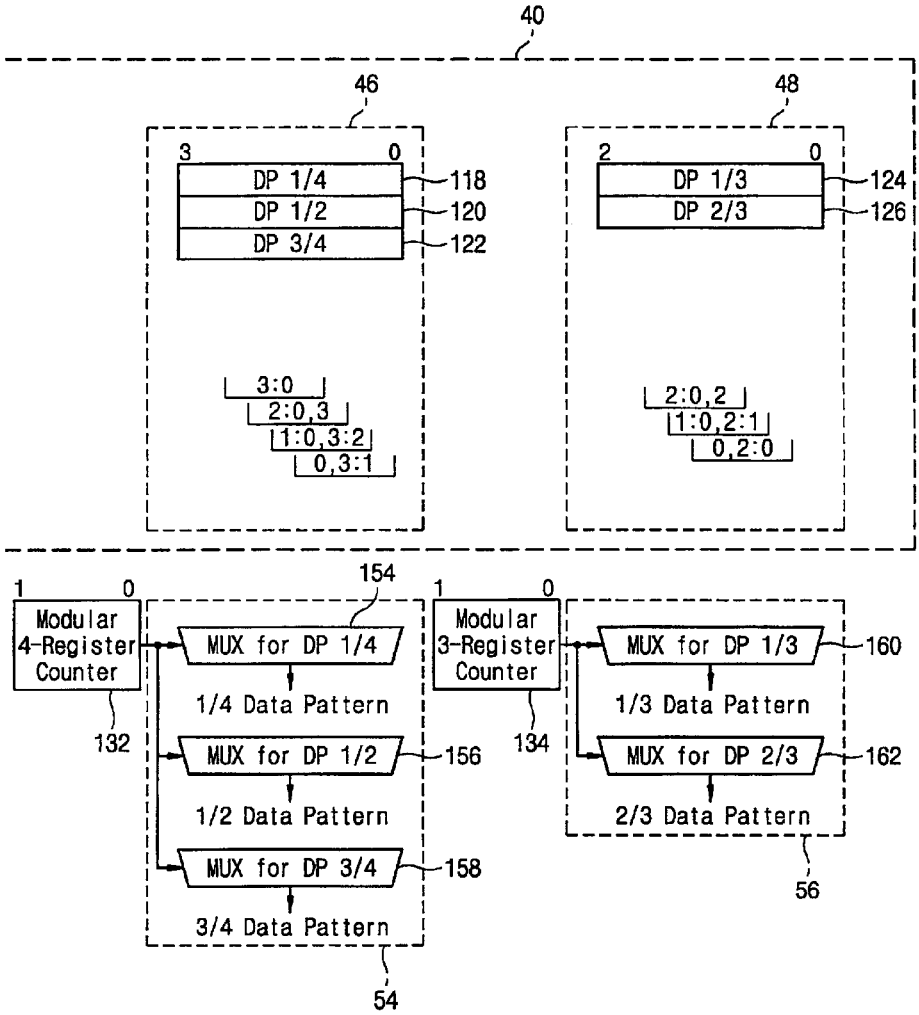

FIGS. 2A and 2B show a block diagram of a dither and frame rate control block according to a preferred embodiment of the present invention. Referring to FIGS. 2A and 2B, the present invention provides dithering value by employing the same bit number as a denominator value of the respective gray levels. The 16 gray levels are defined as "1, 6/7, 4/5, 5/7, 3/4, 2/3, 3/5, 4/7, 1/2, 3/7, 2/5, 1/3, 1/4, 1/5, 1/7 and 0", which can be modified in accordance with a configuration of a LCD controller and characteristics of a LCD device.

A duty cycle value for a gray level is programmed with "0" and "1" using the same bit number as a denominator value of the gray level. For example, duty cycle values are programmed such that a duty cycle value for gray level 6/7 is programmed to "0111111", to "11101" for gray level 4/5, to "1101101" for gray level 5/7, to "0111" for gray level 3/4, to "011" for gray level 2/3, to "01011" for gray level 3/5, to "0101011" for gray level 4/7, to "0110" for gray level 1/2, to "1010100" for gray level 3/7, to "00110" for gray level 2/5, to "100" for gray level 1/3, to "1000" for gray level 1/4, to "10000" for gray level 1/5, and to "0000001" for gray level 1/7.

A dithering pattern register section 40 is divided into four groups, i.e., a first group through a fourth group 42, 44, 46 and 48. The first group 42 stores programmed values of denominator value "7" among 16 gray levels. In other words, dithering pattern values, i.e., "0000001" for gray level 1/7, "1010100" for gray level 3/7, "0101011" for gray level 4/7, "1101101" for gray level 5/7, and "0111111" for gray level 6/7, are respectively stored in blocks 100 through 108.

The second group 44 stores programmed values of denominator value "5" among 16 gray levels. In other words, dithering pattern values, i.e., "10000" for gray level 1/5, "00110" for gray level 2/5, "01011" for gray level 3/5, and "11101" for gray level 4/5, are respectively stored in blocks 110~116.

The third group 46 stores programmed values of denominator value "4" among 16 gray levels. In other words, dithering pattern values, i.e., "1000" for gray level 1/4, "0110" for gray level 1/2 (or 2/4), and "0111" for gray level 3/4, are respectively stored in blocks 118~122.

The fourth group 48 stores programmed values of denominator value "3" among 16 gray levels. In other words, dithering pattern values, i.e., "100" for gray level 1/3 and "011" for gray level 2/3, are respectively stored in blocks 124 and 126.

In FIGS. 2A and 2B, the numbers indicated below the groups 42, 44, 46 and 48 represent 4 bits for pixel values to be provided on LCD panel, which are determined by values provided from modular register counters. A most significant bit (MSB) and a least significant bit (LSB) of 4 bits for the gray levels programmed in the first group 42 are determined in accordance with an output value of the modular 7-register counter 128. A MSB and a LSB of 4 bits for the gray levels programmed in the second group 44 are determined in accordance with an output value of the modular 5-register counter 130. A MSB and a LSB of 4 bits for the gray levels programmed in the third group 46 are determined in accordance with an output value of the modular 4-register counter 132. A MSB and a LSB of 4 bits for the gray levels programmed in the fourth group 48 are determined in accordance with an output value of the modular 3-register counter 134.

The modular register counters 128, 130, 132 and 134 are respectively connected to multiplexer groups 50, 52, 54 and 56, and utilized to select/provide four pixel data. In other words, the modular 7-register counter 128 for determining the MSB of 4 bits for the gray levels programmed in the first group 42 is connected to the first multiplexer group 50 synchronously providing higher 4 bits for the respective gray levels programmed in the first group 42 according to the output value of the modular 7-register counter 128.

The first multiplexer group 50 includes a multiplexer for dithering pattern (DP) 1/7 136, a multiplexer for DP 3/7 138, a multiplexer for DP 4/7 140, a multiplexer for DP 5/7 142, and a multiplexer for DP 6/7 144. The multiplexer for DP 1/7 136 outputs higher 4 bits of the gray level 1/7 programmed as a required duty cycle in accordance with the output value of the modular 7-register counter 128, and the multiplexer for DP 3/7 138 outputs higher 4 bits of the gray level 3/7 programmed as a required duty cycle in accordance with the output value of the modular 7-register counter 128. The multiplexer for DP 4/7 140 outputs higher 4 bits of the gray level 4/7 programmed as a required duty cycle in accordance with the output of the modular 7-register counter 128, and the multiplexer for DP 5/7 142 outputs higher 4 bits of the stored gray level 5/7 programmed as a required duty cycle in accordance with the output value of the modular 7-register counter 128. The multiplexer for DP 6/7 144 outputs higher 4 bits of the stored gray level 6/7 programmed as a required duty cycle in accordance with the output value of the modular 7-register counter 128.

The modular 5-register counter 130 for determining the MSB of 4 bits for the gray levels programmed and stored in the second group 44 is connected to the second multiplexer group 52 synchronously providing higher 4 bits of the respective gray levels stored in the second group 44. The second multiplexer group 52 includes a multiplexer for DP 1/5 146, a multiplexer for DP 2/5 148, a multiplexer for DP 3/5 150, and a multiplexer for DP 4/5 152. The multiplexer for DP 1/5 146 outputs higher 4 bits of the stored gray level 1/5 programmed as a required duty cycle in accordance with the output value of the modular 5-register counter 130, and the multiplexer for DP 2/5 148 outputs higher 4 bits of the stored gray level 2/5 which is programmed as a required duty cycle in accordance with the output value of the counter 130. The multiplexer for DP 3/5 150 outputs higher 4 bits of the stored gray level 3/5 programmed as a required duty cycle in accordance with the output value of the counter 130. The multiplexer for DP 4/5 152 outputs higher 4 bits of the stored gray level 4/5 which is programmed as a required duty cycle in accordance with the modular 5-register counter 130.

The modular 4-register counter 132 for determining the MSB of 4 bits for the gray levels programmed and stored in the third group 46 is connected to the third multiplexer group 54 synchronously providing higher 4 bits of the respective gray levels stored in the third group 46. The third multiplexer group 54 includes a multiplexer for DP 1/4 154, a multiplexer for DP 1/2 156, and a multiplexer for DP 3/4 158. The multiplexer for DP 1/4 154 outputs higher 4 bits of the stored gray level 1/4 programmed as a required duty cycle in accordance with the output value of the modular 4-register counter 132, and the multiplexer for DP 1/2 156 outputs higher 4 bits of the stored gray level 1/2 programmed as a required duty cycle in accordance with the output value of the counter 132. The multiplexer for DP 3/4 158 outputs higher 4 bits of the stored gray level 3/4 programmed as a required duty cycle in accordance with the output value of the counter 132.

The modular 3-register counter 134 for determining the MSB of 4 bits for the gray levels programmed and stored in the fourth group 48 is connected to the fourth multiplexer group 56 synchronously providing higher 4 bits of the respective gray levels stored in the fourth group 48. The fourth multiplexer group 56 includes a multiplexer for DP 1/3 160, and a multiplexer for DP 2/3 162. The multiplexer for DP 1/3 160 outputs higher 4 bits of the stored gray level 1/3 programmed as a required duty cycle in accordance with the output value of the modular 3-register counter 134, and the multiplexer for DP 2/3 162 outputs higher 4 bits of the stored gray level 2/3 programmed as a required duty cycle in accordance with the output value of the modular 3-register counter 134.

As shown in FIGS. 2A and 2B, the dithering pattern values for the gray levels are formed by using the same bit number as a denominator value of the respective gray levels, which minimizes the power consumption by reducing the number of flip-flops.

Figure 3:
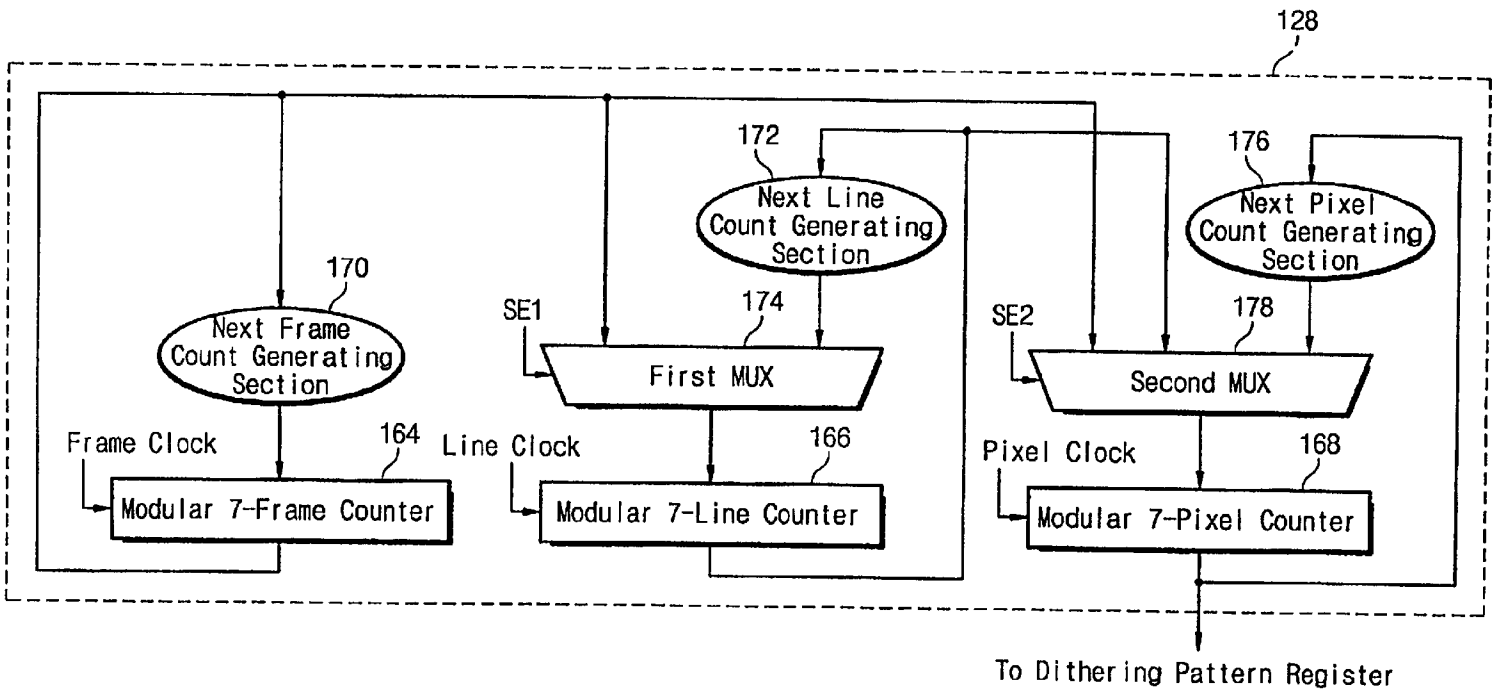
FIG. 3 is a block diagram of a modular register counter shown in FIGS. 2A and 2B.

FIG. 3 is a block diagram illustrating the modular 7-register counter 128 in FIG. 2A. Since all the modular register counters 128, 130, 132, 134, even including any modular register counter whose number is increased in proportion to the number of groups in the dithering pattern register section 40, have the same circuit configuration, a detailed description for the modular register counters 130, 132, 134 is omitted to avoid the redundancy.

In the modular 7-register counter 128, modular 7-frame counter 164 performs counting operation whenever a frame is changed by synchronously responding to frame clock Frame Clock. Modular 7-line counter 166 performs counting operation whenever a line is changed by synchronously responding to line clock Line Clock. Modular 7-pixel counter 168 performs counting operation whenever a pixel is changed by synchronously responding to pixel clock Pixel Clock. A next frame count generating section 170 outputs a value for update to the modular 7-frame counter 164 whenever a frame is changed, in response to an output signal of the frame counter 164. A next line count generating section 172 outputs a value for update whenever a line is changed, in response to an output signal of the modular 7-line counter 166. A first multiplexer 174 reiteratively outputs either an initial value received from the modular 7-frame counter 164 whenever a frame is changed or the value for update received from the next line count generating section 172 whenever a line is changed, to the modular 7-line counter 166 in response to a first selection signal SE1. A next pixel count generating section 176 outputs a value for update whenever a pixel is changed, in response to an output signal of the modular 7-pixel counter 168. A second multiplexer 178 reiteratively outputs the initial value received from the modular 7-frame counter 164 whenever a frame is changed, an initial value from the modular 7-line counter 166 whenever a line is changed, or the value for update provided from the next pixel count generating section 176 whenever a pixel is changed, to the modular 7-pixel counter 168 in response to second selection signal SE2.

The next frame count generating section 170 outputs a value increasing whenever a frame is changed, and the next line count generating section 172 outputs a value increasing whenever a line is changed. The next pixel count generating section 176 outputs a value increasing whenever the pixel is changed.

In the modular register counter having the aforementioned configuration as shown in FIG. 3, the value of the modular line counter is updated in the modular pixel counter whenever a line is changed, to eliminate relevance between patterns of the respective lines. Further, for the purpose of eliminating a temporal relation between the patterns, the value of the modular frame counter is updated in the modular line counter and the modular pixel counter whenever a frame is changed. For example, it is assumed that value of the modular frame counter is reset to "0" when a first line of a first frame is started. Then, at the same time the frame clock is generated, and the reset value "0" of the modular frame counter is transferred to the modular line counter and to the modular pixel counter, respectively. Afterward, the modular frame counter is updated to a value for the next frame. Further, after the line clock is generated, value of the modular line counter is updated to a value of the next modular line counter. The modular pixel counter is updated to a value of the next modular pixel counter whenever the pixel clock is generated, and to the value of the line counter after an operation for one line is over.

Thus, the various counter values allows the duty cycle between frames to be maintained as well as the duty cycle in one line or one program, resulting in temporally and spatially performing the dithering.

Next, an operational relation of the LCD controller according to a preferred embodiment is explained with reference to the foregoing description.

A first example is that 80-pixel data having the same gray level is provided on panel. Here, even though pixel array can be constructed in various ways, 16-pixel data is provided per one line in matrix. Further, it is assumed that the provided gray level is "1/7". Thus, on the panel, programmed data of the gray levels are provided as shown in Table 1 below:

TABLE 1

| | 1st Pixel | 2nd Pixel | 3rd Pixel | 4th Pixel | 5th Pixel | 6th Pixel | 7th Pixel | 8th Pixel | 9th Pixel | 10th Pixel | 11th Pixel | 12th Pixel | 13th Pixel | 14th Pixel | 15th Pixel | 16th Pixel |
|---|---|---|---|---|---|---|---|---|---|---|---|---|---|---|---|---|
| 1st Line | 1/7 | 1/7 | 1/7 | 1/7 | 1/7 | 1/7 | 1/7 | 1/7 | 1/7 | 1/7 | 1/7 | 1/7 | 1/7 | 1/7 | 1/7 | 1/7 |
| 2nd Line | 1/7 | 1/7 | 1/7 | 1/7 | 1/7 | 1/7 | 1/7 | 1/7 | 1/7 | 1/7 | 1/7 | 1/7 | 1/7 | 1/7 | 1/7 | 1/7 |
| 3rd Line | 1/7 | 1/7 | 1/7 | 1/7 | 1/7 | 1/7 | 1/7 | 1/7 | 1/7 | 1/7 | 1/7 | 1/7 | 1/7 | 1/7 | 1/7 | 1/7 |
| 4th Line | 1/7 | 1/7 | 1/7 | 1/7 | 1/7 | 1/7 | 1/7 | 1/7 | 1/7 | 1/7 | 1/7 | 1/7 | 1/7 | 1/7 | 1/7 | 1/7 |
| 5th Line | 1/7 | 1/7 | 1/7 | 1/7 | 1/7 | 1/7 | 1/7 | 1/7 | 1/7 | 1/7 | 1/7 | 1/7 | 1/7 | 1/7 | 1/7 | 1/7 |

First, it is assumed that 4-pixel data is sequentially provided in each line at one time. The modular 7-register counter 128 is updated to a predetermined value, whenever a pixel is changed, a line is changed, and a frame is changed. In other words, the modular 7-pixel counter 168 is increased by "4" whenever a pixel is changed, and the modular 7-line counter 166 is increased by "3" whenever a line is changed. And the modular 7-frame counter 164 is increased by "2" whenever a frame is changed.

As described above, the duty cycle value of the dithering pattern for the gray level 1/7 is "0000001", which is stored in the block 100 of the first group 42 in the dithering pattern register section 40. It is understandable that the duty cycle values of the dithering patterns for the remaining gray levels are also stored in the corresponding blocks 102~126 in the dithering pattern register section 40.

It is assumed that a value of the modular 7-frame counter 164 in the modular 7-register counter 128 is rest to "0" when the first line of the first frame is started. In that case, the reset value "0" of the modular 7-frame counter 164 is transferred in response to the frame clock to the modular 7-line counter 166 and the modular 7-pixel counter 168, respectively. Thus, the modular 7-line counter 166 and the modular 7-pixel counter 168 respectively output "0". In this manner, the modular frame, line, and pixel counters in the modular 5-register counter 130, modular 4-register counter 132, and modular 3-register counter 134 respectively output the value of "0".

Since the system recognizes whether the pixel data for the first 4 pixels on the first line of the first frame is provided, the output values of the modular pixel counters are significant. At this time, the output values of the modular frame counters and the modular line counters are insignificant. The output values of the modular frame and line counters become respectively effective when the line and the frame are changed. In case that only the pixel value is changed, output values of the modular pixel counters are effective. Hence, the modular 7-register counter 128 outputs "0" which is the output value of the modular 7-pixel counter 168. Likewise, the modular 5-register counter 130, the modular 4-register counter 132, and the modular 3-register counter 134 respectively output the value of "0" of the modular 5-pixel counter, of the modular 4-pixel counter, and of the modular 3-pixel counter. As a result, the modular register counters 128, 130, 132 and 134 respectively output "0", so that the MSB of 4 bits (bit field) for a gray level is determined to generate the duty cycle values of the dithering pattern stored in the respective groups 42, 44, 46 and 48 of the dithering pattern register section 40. Thus, the modular 7-register counter 128 determines bit field of the duty cycle values of the respective dithering patterns for gray levels 1/7, 3/7, 4/7, 5/7 and 6/7 stored in the first group 42, i.e., "0000001", "1010100", "0101011", "1101101" and "0111111".

As described above, the $0^{th}$ values from the left of the values are provided to be determined as the MSB of 4 bits, since the output value of the modular 7-register counter 128 is "0". In other words, "0" from "0000001", "1" from "1010100", "0" from "0101011", "1" from "1101101", and "0" from "0111111" are respectively determined as the MSB of the bit field. In the second group 44, due to the output value "0" of the modular 5-register counter 130, "1" from "10000", "0" from "00110", "0" from "01011", and "1" from "11101" are respectively determined as the MSB of the bit field. In the third group 46, "1" from "1000", "0" from "0110", and "0" from "0111" are respectively determined as the MSB of the bit field, due to the output value "0" of the modular 4-register counter 132. And by the output value "0" of the modular 3-register counter 134, "1" from "100", and "0" from "011" are respectively determined as the MSB of the bit field in the fourth group 48.

The numbers indicated below the groups 42, 44, 46 and 48 express that higher 4 bits determined in accordance with the output values of the modular register counters 128, 130, 132 and 134 are selected. In the duty cycle "0000001" of the dithering pattern for the gray level 1/7 in the first group 42, if the modular 7-pixel counter 168 is increased by "4" for the first 4 pixel values in the first line of the first frame, the first pixel is selected from $6^{th}$ to $3^{rd}$ bits from the right (6:3). That is, "0000" is selected through the multiplexer for DP 1/7. The second pixel is selected from $2^{nd}$ to $0^{th}$ bits and $6^{th}$ bit from the right (2:0, 6), for the modular 7-pixel counter 168 is increased by "4". That is, "0010" is selected through the multiplexer for DP 1/7. The third pixel is selected from $5^{th}$ to $2^{nd}$ bits from the right (5:2), i.e. "0000" through the multiplexer for DP 1/7, for the modular 7-pixel counter 168 is again increased by "4". If the modular 7-pixel counter 168 is again increased by "4", the fourth pixel is selected from the first and $0^{th}$ bits (1:0) and $6^{th}$ and $5^{th}$ bits (6:5) from the right, i.e., "0100" is selected through the multiplexer for the DP 1/7. Each of the pixel values of the selected 4-bit field is finally selected by a selection means to be assigned in a corresponding pixel as one data value. In other words, a first column value "0" from "0000" is assigned in the first pixel, and a second column value "0" from "0010" is assigned in the second pixel. A third column value "0" from "0000" is assigned in the third pixel. A fourth column value "0" from "0100" is assigned in the fourth pixel.

The multiplexer groups 50, 52, 54 and 56 shown in FIGS. 2A and 2B select/output a bit field of the higher 4 bits which are determined from output values of the modular register counters 128, 130, 132 and 134. That is, the multiplexers in the first multiplexer group 50 select/output 4-bit bit fields for the first group 42. For example, the multiplexer for DP 1/7 136 selects/outputs the value from $6^{th}$ to $3^{rd}$ bit, i.e., "0000" from "0000001" that is the duty cycle value of the dithering pattern for the gray level 1/7. The multiplexer for DP 3/7 138 selects/outputs the value from $6^{th}$ to $3^{rd}$ bit, i.e., "1010" from "1010100" that is the duty cycle value of the dithering pattern for the gray level 3/7. The multiplexer for DP 4/7 140 selects/outputs the value from $6^{th}$ to $3^{rd}$ bit, i.e., "0101" from "0101011" that is the duty cycle value of the dithering pattern for the gray level 4/7. The multiplexer for DP 5/7 142 selects/outputs the value from $6^{th}$ to $3^{rd}$ bit, i.e., "1101" from "1101101" that is the duty cycle value of the dithering pattern for the gray level 5/7. The multiplexer for DP 6/7 144 selects/outputs the bit values from $6^{th}$ to $3^{rd}$ bit, i.e., "0111" from "011111" that is the duty cycle value of the dithering pattern for the gray level 6/7.

The multiplexers in the second multiplexer group 52 select/output 4-bit bit fields for the second group 44. For example, the multiplexer for DP 1/5 146 selects/outputs the value from $4^{th}$ to $1^{st}$ bit, i.e., "1000" from "10000" that is the duty cycle value of the dithering pattern for the gray level 1/5. The multiplexer for DP 2/5 148 selects/outputs the value from $4^{th}$ to $1^{st}$ bit, i.e., "0011" from "00110" that is the duty cycle value of the dithering pattern for the gray level 2/5. The multiplexer for DP 3/5 150 selects/outputs bit value from $4^{th}$ to $1^{st}$ bit, i.e., "0101" from "01011" that is the duty cycle value of the dithering pattern for the gray level 3/5. The multiplexer for DP 4/5 152 selects/outputs the value from $4^{th}$ to $1^{st}$ bit, i.e., "1110" from "11101" that is the duty cycle value of the dithering pattern for the gray level 4/5.

Further, the multiplexers in the third multiplexer group 54 select/output 4-bit bit fields for the third group 46. The multiplexer for DP 1/4 154 selects/outputs the value from $3^{rd}$ to $0^{th}$ bit, i.e., "1000" from "1000" that is the duty cycle value of the dithering pattern for the gray level 1/4. The multiplexer for DP 1/2 156 selects/outputs the value from $3^{rd}$ to $0^{th}$ bit, i.e., "0110" from "0110" that is the duty cycle value of the dithering pattern for the gray level 1/2. The multiplexer for DP 3/4 158 selects/outputs the value from $3^{rd}$ to $0^{th}$ bit, i.e., "0111" from "011" that is the duty cycle value of the dithering pattern for the gray level 3/4.

The multiplexers in the fourth multiplexer group 56 select/output 4-bit bit fields for the fourth group 48. The multiplexer for DP 1/3 160 selects/outputs the value from $2^{nd}$ to $0^{th}$ bit and again $2^{nd}$ bit, i.e., "1001" from "100" that is the duty cycle value of the dithering pattern for the gray level 1/3. The multiplexer for DP 2/3 162 selects/outputs the value from $2^{nd}$ to $0^{th}$ bit and again $2^{nd}$ bit, i.e., "0110" from "011" that is the duty cycle value of the dithering pattern for the gray level 2/3.

In this manner, the respective data patterns for the 16 gray levels are assigned in a corresponding pixel on the panel as one bit being finally selected.

Since all the pixel values are assumed as "1/7" in the invention, as shown in the Table 1, the data patterns relevant to the gray level 1/7 are effective here.

In the first line in the Table 1, each pixel data is filled with data pattern selected by the multiplexer for DP 1/7 in the first multiplexer group 50. That is, corresponding column bit values among "0000", "0010", "0000", and "0100" are respectively assigned to first through fourth pixels in the first line. A third bit value "0" from the right of "0000" is assigned in the first pixel. A second bit value "0" from the right of "0010" is assigned in the second pixel. A first bit value "0" from the right of "0000" is assigned in the third pixel. A $0^{th}$ bit value "0" from the right of "0100" is assigned in the fourth pixel. Further, corresponding column bit values among "0000", "1000", "0001" and "0000" are respectively assigned to fifth through eighth pixels of the first line. A third bit value "0" from the right of "0000" is assigned in the fifth pixel. A second bit value "0" from the right of "1000" is assigned in the sixth pixel. A first bit value "0" from the right of "0001" is assigned in the seventh pixel. A $0^{th}$ bit value "0" from the right of "0000" is assigned in the eighth pixel. In ninth through twelfth pixels, corresponding column bit values among "0010", "0000", "0100", and "0000" are respectively assigned. In other words, a third bit value "0" from the right of "0010" is assigned in the ninth pixel. A second bit value "0" from the right of "0000" is assigned in the tenth pixel. A first bit value "0" from the right of "0100" is assigned in the eleventh pixel. A $0^{th}$ bit value "0" from the right of "0000" is assigned in the twelfth pixel. As the counting values are increased by "4" from the former pixels in thirteenth through sixteenth pixels, corresponding column bit values among "1000", "0001", "0000", and "0010" are assigned. That is, a third bit value "1" from the right of "1000" is assigned in the thirteenth pixel. A second bit value "0" from the right of "0001" is assigned in the fourteenth pixel. A first bit value "0" from the right of "0000" is assigned in the fifteenth pixel. A $0^{th}$ bit value "0" from the right of "0010" is assigned in the sixteenth pixel.

Next, an output process of the pixel data for the second line is progressed. As described above, the modular pixel counter is increased by "4" whenever the pixel is changed, and the modular line counter is increased by "3" whenever the line is changed. The modular frame counter is increased by "2" whenever the frame is changed. The modular frame counter is reset to an initial value whenever the frame is changed and the modular line counter is reset to an initial value whenever the frame is changed.

When the line is changed, all the counters are reset to initial values. Thus, the modular 7-frame counter 164, the modular 7-line counter 166, and the modular 7-pixel counter 168 respectively output "0". As the modular 7-line counter 166 is increased by "3" whenever the line is changed, the initial value becomes "3". The initial value of the modular 7-pixel counter 168 becomes "3", since the output value "3" of the modular 7-line counter 166 is transferred to the modular 7-pixel counter 168, as shown in FIG. 3. Briefly, the modular 7-frame counter 164, the modular 7-line counter 166, the modular 7-pixel counter 168 respectively output "0", "3" and "3" as the last initial values. The next operation for the second line formed of 16 pixels is the operation between the pixels, so that the modular 7-pixel counter 168 is increased by "4" whenever the pixel is changed. And the initial values of the modular 7-frame counter 164 and modular 7-line counter 166 are respectively fixed to "0" and "3".

Thus, the initial values of the modular 7-register counter 128, the modular 5-register counter 130, the modular 4-register counter 132, and the modular 3-register counter 134 respectively becomes 3 as the initial value of the modular pixel counter. A detailed description of the data patterns relevant to the modular counters 130, 132 and 134 are omitted to avoid the redundancy.

An output relation for the respective pixel data in the second line is progressed in the same manner with that in the first line. The duty cycle value of the dithering pattern of DP 1/7 is increased by "4" whenever a pixel is changed as before without a difference, except that the bit field thereof is determined from the third bit from the left.

Thus, it will be described herein about data patterns of bit filed of 4 bits and last bit values. A detailed description for third, fourth, and fifth lines will be omitted, but how the initial values are changed whenever a line is changed will be explained in detail.

For the first through fourth pixels in the second line, data pattern is selected/provided with being increased by "4" from the third bit from the left of "0000001". Thus, "0001", "0000", "0010", and "0000" are selected as the data patterns, and "0", "0", "1", and "0" are respectively provided to the four pixels through a selection means. In the fifth through eighth pixels in the second line, "0100", "0000", "1000" and "0001" are selected as the data patterns, and "0", "0", "0", and "1" are respectively provided thereto. In the ninth through twelfth pixels, "0000", "0010", "0000", and "0100" are selected as the data patterns, and "0", "0", "0", and "0" are respectively provided thereto. In the thirteenth through sixteenth pixels in the second line, "0000", "1000", "0001" and "0000" are selected as the data patterns, and "0", "0", "0", and "0" are respectively provided thereto.

In the third line, because of the value "3" of the modular 7-line counter 166 and a value being increased by "3" whenever the line is changed, even though the modular 7-pixel counter 168 is reset, the value of "6" is finally transferred to the modular 7-pixel counter 168. Thus, the modular 7-register counter 128 has the value "6" as an initial value. As a result, the third line provides data patterns being increased by "4" from the sixth bit from the left of "0000001". In other words, in the first through fourth pixels in the third line, "1000", "0001", "0000", and "0010" are selected as the data patterns, and "1", "0", "0", and "0" are respectively provided thereto. In the fifth through eighth pixels, "0000", "0100", "0000" and "1000" are selected as the data patterns, and "0", "1", "0", and "0" are respectively provided thereto. In the ninth through twelfth pixels, "0001", "0000", "000", and "0000" are selected as the data patterns, and "0", "0", "1", and "0" are respectively provided thereto. In the thirteenth through sixteenth pixels, "0100", "0000", "1000", and "0001" are selected as the data pattern, and "0", "0", "0", and "1" are respectively provided thereto.

The modular 7-pixel counter 168 in the fourth line is increased from 2 by 4. Because the duty cycle value of the dithering pattern for the gray level 1/7 is constructed as 7 bits, it is reiterated when the counting value is over 6. Thus, in the first through fourth pixels in the fourth line, "0000", "1000", "0001", and "0000" are selected as the data patterns, and "0", "0", "0", and "0" are respectively provided thereto. In the fifth through eighth pixels, "0010", "0000", "0100", and "0000" are respectively selected as the data patterns, and "0", "0", "0", and "0" are respectively provided thereto. In the ninth through twelfth pixels, "1000", "0001", "0000", and "0010" are respectively selected as the data patterns, and "1", "0", "0", and "0" are respectively provided. In the thirteenth through sixteenth pixels, "0000", "0100", "0000", and "1000" are selected as the data pattern, and "0", "1", "0", and 0" are respectively provided thereto.

The modular 7-pixel counter 168 in the fifth line is increased from "5" by "4". Thus, in the first through fourth pixels in the fifth line, "0100", "0000", "1000", and "0001" are selected as the data patterns, and "0", "0", "0", and "1" are respectively provided thereto. In the fifth through eighth pixels, "0000", "0010", "0000", and "0100" are selected as the data patterns, and "0", "0", "0", and "0" are respectively provided thereto. In the ninth through twelfth pixels, "0000", "1000", "0001", and "0000" are selected as the data patterns, and "0", "0", "0", and "0" are respectively provided. In the thirteenth through sixteenth pixels, "0010", "0000", "0100", and "0000" are selected as the data pattern, and "0", "0", "0", and 0" are respectively provided thereto, resulting in completing the operation for 1 frame. As a result, the modular 7-frame counter 164 provides "2".

The foregoing output data will be illustrated in Table 2 below:

TABLE 2

| | 1st Pixel | 2nd Pixel | 3rd Pixel | 4th Pixel | 5th Pixel | 6th Pixel | 7th Pixel | 8th Pixel | 9th Pixel | 10th Pixel | 11th Pixel | 12th Pixel | 13th Pixel | 14th Pixel | 15th Pixel | 16th Pixel |
|---|---|---|---|---|---|---|---|---|---|---|---|---|---|---|---|---|
| 1st Line | 0 | 0 | 0 | 0 | 0 | 0 | 0 | 0 | 0 | 0 | 0 | 0 | 1 | 0 | 0 | 0 |
| 2nd Line | 0 | 0 | 1 | 0 | 0 | 0 | 0 | 1 | 0 | 0 | 0 | 0 | 0 | 0 | 0 | 0 |
| 3rd Line | 1 | 0 | 0 | 0 | 0 | 1 | 0 | 0 | 0 | 0 | 1 | 0 | 0 | 0 | 0 | 1 |
| 4th Line | 0 | 0 | 0 | 0 | 0 | 0 | 0 | 0 | 1 | 0 | 0 | 0 | 0 | 1 | 0 | 0 |
| 5th Line | 0 | 0 | 0 | 1 | 0 | 0 | 0 | 0 | 0 | 0 | 0 | 0 | 0 | 0 | 0 | 0 |

A second example is shown in Table 3 below. The Table 3 shows a case that 80 pixel arrays are formed and 16 gray levels are randomly provided to the respective pixels.

TABLE 3

| | 1st Pixel | 2nd Pixel | 3rd Pixel | 4th Pixel | 5th Pixel | 6th Pixel | 7th Pixel | 8th Pixel | 9th Pixel | 10th Pixel | 11th Pixel | 12th Pixel | 13th Pixel | 14th Pixel | 15th Pixel | 16th Pixel |
|---|---|---|---|---|---|---|---|---|---|---|---|---|---|---|---|---|
| 1st Line | 6/7 | 4/5 | 5/7 | 3/4 | 2/3 | 3/5 | 4/7 | 1/2 | 3/7 | 2/5 | 1/3 | 1/4 | 1/5 | 1/7 | 6/7 | 4/5 |
| 2nd Line | 5/7 | 3/4 | 2/3 | 3/5 | 4/7 | 1/2 | 3/7 | 2/5 | 1/3 | 1/4 | 1/5 | 1/7 | 6/7 | 4/5 | 5/7 | 3/4 |
| 3rd Line | 2/3 | 3/5 | 4/7 | 1/2 | 3/7 | 2/5 | 1/3 | 2/4 | 1/5 | 1/7 | 6/7 | 4/5 | 5/7 | 3/4 | 2/3 | 3/5 |
| 4th Line | 4/7 | 1/2 | 3/7 | 2/5 | 1/3 | 1/4 | 1/5 | 1/7 | 6/7 | 4/5 | 5/7 | 3/4 | 2/3 | 3/5 | 4/7 | 1/2 |
| 5th Line | 3/7 | 2/5 | 1/3 | 1/4 | 1/5 | 1/7 | 6/7 | 4/5 | 5/7 | 3/4 | 2/3 | 3/5 | 4/7 | 1/2 | 3/7 | 2/5 |

It is assumed that four pixel data are sequentially provided at one time in each line, and a counting value of a corresponding modular register counter is increased by "1" whenever the pixel is changed, by "2" whenever the line is changed, and by "3" whenever the frame is changed. Further, the modular 7-frame counter, modular 5-frame counter, modular 4-frame counter, and modular 3-frame counter respectively in the modular register counters 128, 130, 132, and 134 are reset to the value of "0" when the first line of the first frame is started.

In this condition, when the frame clock Frame Clock is applied, output value "0" of a modular frame counter is transferred to a modular line counter and a modular pixel counter in each of the modular register counters. Thus, the modular 7-line counter, the modular 5-line counter, the modular 4-line counter, and the modular 3-line counter respectively output the value of "0". Likewise, the modular 7-pixel counter, the modular 5-pixel counter, the modular 4-pixel counter, and the modular 3-pixel counter respectively outputs the value of "0".

In the first line of the first frame, only the pixel is changed, so that the modular register counters 128, 130, 132, and 134 finally output the value 0 which is the output value of the modular pixel counters.

With reference to the foregoing Table 3, outputs of the modular register counters 128, 130, 132, and 134 are shown in Table 4 below:

TABLE 4

| | Modular 7-register Counter | Modular 5-register counter | Modular 4-register counter | Modular 3-register counter |
|---|---|---|---|---|
| 1st~4th Pixel in 1st Line | 0 | 0 | 0 | 0 |
| 5th~8th Pixel in 1st Line | 1 | 1 | 1 | 1 |
| 9th~12th Pixel in 1st Line | 2 | 2 | 2 | 2 |
| 13th~16 Pixel in 1st Line | 3 | 3 | 3 | 0 |
| 1st~4th Pixel in 2nd Line | 2 | 2 | 2 | 2 |
| 5th~8th Pixel in 2nd Line | 3 | 3 | 3 | 0 |

TABLE 4-continued

| | Modular 7-register Counter | Modular 5-register counter | Modular 4-register counter | Modular 3-register counter |
|---|---|---|---|---|
| 9th~12th Pixel in 2nd Line | 4 | 4 | 0 | 1 |
| 13th~16th Pixel in 2nd Line | 5 | 0 | 1 | 2 |
| 1st~4th Pixel in 3rd Line | 4 | 4 | 0 | 1 |
| 5th~8th Pixel in 3rd Line | 5 | 0 | 1 | 2 |
| 9th~12th Pixel in 3rd Line | 6 | 1 | 2 | 0 |
| 13th~16th Pixel in 3rd Line | 0 | 2 | 3 | 1 |
| 1st~4th Pixel in 4th Line | 6 | 1 | 2 | 0 |
| 5th~8th Pixel in 4th Line | 0 | 2 | 3 | 1 |
| 9th~12th Pixel in 4th Line | 1 | 3 | 0 | 2 |
| 13th~16th Pixel in 4th Line | 2 | 4 | 1 | 0 |
| 1st~4th Pixel in 5th Line | 1 | 3 | 0 | 2 |
| 5th~8th Pixel in 5th Line | 2 | 4 | 1 | 0 |
| 9th~12th Pixel in 5th Line | 3 | 0 | 2 | 1 |
| 13th~16th Pixel in 5th Line | 4 | 1 | 3 | 2 |

With reference to the Tables 3 and 4, output relation of the pixel data for the respective pixels will be explained. First, the output relation of the pixel data for the first through fourth pixels in the first line is as follows.

The duty cycle values of the dithering pattern for the gray levels 6/7, 4/5, 5/7 and 3/4 stored in the dithering pattern register 40 are respectively "0111111", "11101", "1101101", and "0111". Further, the output values of the modular 7-register counter 128, the modular 5-register counter 130, and the modular 4-register counter 132 of the first through fourth pixels in the first line are respectively "0", as shown in the above Table 4. Briefly, the data pattern values provided from the multiplexers shown in FIGS. 2A and 2B are four bits from $0^{th}$ bit from the left in the duty cycle of the dithering pattern. Thus, the data pattern values for the gray levels 6/7, 4/5, 5/7, and 3/4 provided from the multiplexers for DP 6/7 144, for DP 4/5 152, for DP 5/7 142, and for DP 3/4 158 are respectively "0111", "1110", "1101", and "0111". The last pixel data value of the first pixel for the gray level 6/7 is "0" of third bit value from the right of "0111". The last pixel data value of the second pixel for the gray level 4/5 is "1" of second bit from the right of "1110". The last pixel data value of the third pixel for the gray level 5/7 is "0" of first bit from the right of "1101". The last pixel data value of the fourth pixel for the gray level 3/4 is "1" of $0^{th}$ bit from the right of "0111".

Next, the output relation of the pixel data for the fifth through eighth pixels in the first line is as follows.

The duty cycle values for the gray levels 2/3/, 3/5, 4/7, and 1/2 stored in the dithering pattern register 40 are respectively "011", "01011", "0101011", and "0110". Further, with reference to the Table 4, the output values of the modular 7-register counter 128, the modular 5-register counter 130, the modular 4-register counter 132, and the modular 3-register counter 134 of the fifth through eighth pixels in the first line are respectively 1 (it is assumed that the counting value is increased by "1" whenever the pixel is changed). Briefly, the data pattern values provided from the multiplexers shown in FIGS. 2A and 2B are four bits from $1^{st}$ bit from the left in the duty cycle of the dithering pattern. Thus, the data pattern values for the gray levels 2/3, 3/5, 4/7, and 1/2 provided from the multiplexers for DP 2/3 162, for DP 3/5 150, for DP 4/7 140, and for DP 1/2 156 are respectively "1101", "1011", "1010", and "1100". The last pixel data value of the fifth pixel for the gray level 2/3 is "1" of the third bit value from the right of "1101". The last pixel data value of the sixth pixel for the gray level 3/5 is "0" of second bit from the right of "1011". The last pixel data value of the seventh pixel for the gray level 4/7 is "1" of the first bit from the right of "1010". The last pixel data value of the eighth pixel for the gray level 1/2 is "0" of the $0^{th}$ bit from the right of "1100".

The output relation of the pixel data for the ninth through twelfth pixels in the first line is as follows.

The duty cycle values of the dithering pattern for the gray level 3/7, 2/5, 1/3, and 1/4 stored in the dithering pattern register 40 are respectively "1010100", "00110", "100", and "1000". Referring to the Table 4, the output values of the modular 7-register counter 128, the modular 5-register counter 130, the modular 4-register counter 132, and the modular 3-register counter 134 of the ninth through twelfth pixels in the first line are respectively "2" (it is assumed that the counting value is increased by "1" whenever the pixel is changed). Briefly, the data pattern values provided from the multiplexers shown in FIGS. 2A and 2B are four bits from the $2^{nd}$ bit from the left in the duty cycles of the dithering patterns. Thus, the data pattern values for the gray levels 3/7, 2/5, 1/3, and 1/4 provided from the multiplexers for DP 3/7 138, for DP 2/5 148, for DP 1/3 160, and for DP 1/4 154 are respectively "1010", "1100", "0100", and "0010". The last pixel data value of the ninth pixel for the gray level 3/7 is "1" of the third bit value from the right of "1010". The last pixel data value of the tenth pixel for the gray level 2/5 is "1" of the second bit from the right of "1100". The last pixel data value of the eleventh pixel for the gray level 1/3 is "0" of the first bit from the right of "0100". The last pixel data value of the twelfth pixel for the gray level 1/4 is "0" of the $0^{th}$ bit from the right of "0010".

The output relation of the pixel data for the thirteenth through sixteenth pixels in the first line is as follows.

The duty cycle values of the dithering pattern for the gray levels 1/5, 1/7, 6/7, and 4/5 stored in the dithering pattern register 40 are respectively "10000", "0000001", "0111111", and "11101". Referring to the Table 4, the output values of the modular 7-register counter 128 and the modular 5-register counter 130 of the thirteenth through sixteenth pixels in the first line are respectively "3" (it is assumed that the counting value is increased by "1" whenever the pixel is changed). Briefly, the data pattern values provided from the multiplexers shown in FIGS. 2A and 2B are four bits from the $3^{rd}$ bit from the left in the duty cycles of the dithering patterns. Thus, the data pattern values for the gray levels 1/5, 1/7, 6/7, and 4/5 provided from the multiplexers for DP 1/5 146, for DP 1/7 136, for DP 6/7 144, and for DP 4/5 152 are respectively "0010", "0001", "1111", and "0111". The last pixel data value of the thirteenth pixel for the gray level 1/5 is "0" of the third bit value from the right of "0010". The last pixel data value of the fourteenth pixel for the gray level 1/7 is "0" of the second bit from the right of "0001". The last pixel data value of the fifteenth pixel for the gray level 6/7 is "1" of the first bit from the right of "1111". The last pixel data value of the sixteenth pixel for the gray level 4/5 is "1" of the $0^{th}$ bit from the right of "0111".

Next, the output relation of the pixel data for the first through fourth pixels in the second line is as follows.

The duty cycle values of the dithering pattern for the gray levels 5/7, 3/4, 2/3, and 3/5 stored in the dithering pattern register 40 are respectively "1101101", "0111", "011", and "01011". Referring to the Table 4, the output values of the modular 7-register counter 128, the modular 5-register counter 130, the modular 4-register counter 132, and the modular 3-register counter 134 of the first through fourth pixels in the second line are respectively "2" (it is assumed that the counter is reset whenever the line is changed, and the counting value is increased by "2"). Briefly, the data pattern values provided from the multiplexers shown in FIGS. 2A and 2B are four bits from the $2^{nd}$ bit from the left in the duty cycles of the dithering patterns. Thus, the data pattern values for the gray levels 5/7, 3/4, 2/3, and 3/5 provided from the multiplexers for DP 5/7 142, for DP 3/4 158, for DP 2/3 162, and for DP 3/5 150 are respectively "0110", "1101", "1011", and "0110". The last pixel data value of the first pixel for the gray level 5/7 is "0" of the third bit value from the right of "010". The last pixel data value of the second pixel for the gray level 3/4 is "1" of the second bit from the right of "1101". The last pixel data value of the third pixel for the gray level 2/3 is "1" of the first bit from the right of "1011". The last pixel data value of the fourth pixel for the gray level 3/5 is "0" of the $0^{th}$ bit from the right of "0110".

The output relation of the pixel data for the fifth through eighth pixels in the second line is as follows.

The duty cycle values of the dithering pattern for the gray levels 4/7, 1/2, 3/7, and 2/5 stored in the dithering pattern register 40 are respectively "0101011", "0110", "1010100", and "00110". Referring to the Table 4, the output values of the modular 7-register counter 128, the modular 5-register counter 130, and the modular 4-register counter 132 of the fifth through eighth pixels in the second line are respectively 3 (it is assumed that the counting value is increased by "1" whenever the pixel is changed). Briefly, the data pattern values provided from the multiplexers shown in FIGS. 2A and 2B are four bits from the $3^{rd}$ bit from the left in the duty cycles of the dithering patterns. Thus, the data pattern values for the gray levels 4/7, 1/2, 3/7, and 2/5 provided from the multiplexers for DP 4/7 140, for DP 1/2 156, for DP 3/7 138, and for DP 2/5 148 are respectively "1011", "0011", "0100", and "1000". The last pixel data value of the fifth pixel for the gray level 4/7 is "1" of the third bit value from the right of "1011". The last pixel data value of the sixth pixel for the gray level 1/2 is "0" of the second bit from the right of "0011". The last pixel data value of the seventh pixel for the gray level 3/7 is "0" of the first bit from the right of "0100". The last pixel data value of the eighth pixel for the gray level 2/5 is "0" of the $0^{th}$ bit from the right of "1000".

The output relation of the pixel data for the ninth through twelfth pixels in the second line is as follows.

The duty cycle values of the dithering pattern for the gray levels 1/3, 1/4, 1/5, and 1/7 stored in the dithering pattern register 40 are respectively "100", "1000", "10000", and "0000001". Referring to the Table 4, the output values of the modular 7-register counter 128 and the modular 5-register counter 130 are respectively "4" (it is assumed that the counting value is increased by "1" whenever the pixel is changed). The output value of the modular 4-register counter 132 is "1" (it is assumed that the counting value is increased by "1", and the counter 132 can count to "3"). The output value of the modular 3-register counter 134 is "1" (it is assumed that the counting value is increased by "1" whenever the pixel is changed). Briefly, the data pattern values provided from the multiplexers shown in FIGS. 2A and 2B are four bits from the $4^{th}$ bit from the left in the duty cycles of the dithering patterns for the gray levels 1/7 and 1/5, from the $0^{th}$ bit for the gray level 1/4, and from the $1^{st}$ bit for the gray level 1/3. Thus, the data pattern value for the gray level 1/3 is "0010". The data pattern value for the gray level 1/4 is "1000". The data pattern values for the gray levels 1/5 and 1/7 are respectively "0100" and "0010". The last pixel data value of the ninth pixel for the gray level 1/3 is "0" of the third bit value from the right of "0010". The last pixel data value of the tenth pixel for the gray level 1/4 is "0" of the second bit from the right of "1000". The last pixel data value of the eleventh pixel for the gray level 1/5 is "0" of the first bit from the right of "0100". The last pixel data value of the twelfth pixel for the gray level 1/7 is "0" of the $0^{th}$ bit from the right of "0010".

The output relation of the pixel data for the thirteenth through sixteenth pixels in the second line is as follows.

The duty cycle values of the dithering pattern for the gray levels 6/7, 4/5, 5/7, and 3/4 stored in the dithering pattern register 40 are respectively "0111111", "11101", "1101101", and "0111". Referring to the Table 4, the output value of the modular 7-register counter 128 of the thirteenth through sixteenth pixels in the second line is "5" (it is assumed that the counting value is increased by "1" whenever the pixel is changed). The output value of the modular 5-register counter 130 is 0 (it is assumed that the counting value is increased by "1" whenever the pixel is changed, and the counter 130 can count to "4"). The output value of the modular 4-register counter 132 is "1" (it is assumed that the counting value is increased by "1" whenever the pixel is changed). The output value of the modular 3-register counter 134 is "2" (it is assumed that the counting value is increased by "1" whenever the pixel is changed). Briefly, the data pattern values provided from the multiplexers shown in FIGS. 2A and 2B are four bits from the $5^{th}$ bit from the left in the duty cycles of the dithering patterns for the gray level 6/7, from the $0^{th}$ bit for the gray level 4/5, from the $1^{st}$ bit for the gray level 5/7, and from the $2^{nd}$ bit for the gray level ¾. Thus, the data pattern value provided from the multiplexer for DP 6/7 144 for the gray level 6/7 is "1101". The data pattern value provided from the multiplexer for DP 4/5 152 for the gray level 4/5 is "1110". The data pattern value provided from the multiplexer for DP 5/7 142 for the gray level 5/7 is "0111". The data pattern value provided from the multiplexer for DP ¾ 158 for the gray level ¾ is "1101. Thus, the last pixel data value of the thirteenth pixel for the gray level 6/7 is 1" of the third bit value from the right of "1101". The last pixel data value of the fourteenth pixel for the gray level 4/5 is "1" of the second bit from the right of "1110". The last pixel data value of the fifteenth pixel for the gray level 5/7 is "1" of the first bit from the right of "0111". The last pixel data value of the sixteenth pixel for the gray level ¾ is "1" of the $0^{th}$ bit from the right of "1101".

Next, the output relation of the pixel data for the first through fourth pixels in the third line is as follows.

The duty cycle values of the dithering pattern for the gray levels ⅔, 3/5, 4/7, and ½ stored in the dithering pattern register 40 are respectively "011", "01011", "0101011", and "0110". In the Table 4, the output value of the modular 7-register counter 128 of the first through fourth pixels in the third line is "4" (it is assumed that the counting value is increased by "2" whenever the line is changed). The output value of the modular 5-register counter 130 is "4" (it is assumed that the counting value is increased by "2" whenever the line is changed). The output value of the modular 4-register counter 132 is "0" (it is assumed that the counting value is increased by "2", and the counter 132 can count to "3"). The output value of the modular 3-register counter 134 is "1" (it is assumed that the counting value is increased by "2" whenever the line is changed, and the counter 134 can count to "2"). Briefly, the data pattern values provided from the multiplexers shown in FIGS. 2A and 2B are four bits from the $4^{th}$ bit from the left in the duty cycles of the dithering patterns for the gray level ⅔, from the $4^{th}$ bit for the gray level 3/5, from the $0^{th}$ bit for the gray level 4/7, and from the $1^{st}$ bit for the gray level ½. Thus, the data pattern value provided from the multiplexer for DP ⅔ 162 for the gray level ⅔ is "1101". The data pattern value provided from the multiplexer for DP 3/5 150 for the gray level 3/5 is "1010". The data pattern value provided from the multiplexer for DP 4/7 for the gray level 4/7 is "0110". The data pattern value provided from the multiplexer for DP ½ for the gray level ½ is "0110." Thus, the last pixel data value of the first pixel for the gray level ⅔ is "1" of the third bit value from the right of "1101". The last pixel data value of the second pixel for the gray level 3/5 is "0" of the second bit from the right of "1010". The last pixel data value of the third pixel for the gray level 4/7 140 is "1" of the first bit from the right of "0110". The last pixel data value of the fourth pixel for the gray level ½ 156 is "0" of the $0^{th}$ bit from the right of "0110".

The output relation of the pixel data for the fifth through eighth pixels in the third line is as follows.

The duty cycle values of the dithering pattern for the gray levels 3/7, 2/5, ⅓, and ¼ stored in the dithering pattern register 40 are respectively "1010100", "00110", "100", and "1000". In the Table 4, the output value of the modular 7-register counter 128 of the fifth through eighth pixels in the third line is "5" (it is assumed that the counting value is increased by "1" whenever the pixel is changed). The output value of the modular 5-register counter 130 is "0" (it is assumed that the counting value is increased by "1" whenever the pixel is changed, and the counter 130 can count to "4"). The output value of the modular 4-register counter 132 is "1" (it is assumed that the counting value is increased by "1" whenever the pixel is changed). The output value of the modular 3-register counter 134 is "2" (it is assumed that the counting value is increased by "1" whenever the pixel is changed). Briefly, the data pattern values provided from the multiplexers shown in FIGS. 2A and 2B are four bits from the $5^{th}$ bit from the left in the duty cycles of the dithering patterns for the gray level 3/7, from the $0^{th}$ bit for the gray level 2/5, from the $1^{st}$ bit for the gray level ⅓, and from the $2^{nd}$ bit for the gray level ¼. Thus, the data pattern value provided from the multiplexer for DP 3/7 138 for the gray level 3/7 is "0010". The data pattern value provided from the multiplexer for DP 2/5 148 for the gray level 2/5 is "0011". The data pattern value provided from the multiplexer for DP ⅓ 160 for the gray level ⅓ is "0010". The data pattern value provided form the multiplexer for DP ¼ 154 for the gray level ¼ is "0010". Thus, the last pixel data value of the fifth pixel for the gray level 3/7 is "0" of the third bit value from the right of "0010". The last pixel data value of the sixth pixel for the gray level 2/5 is "0" of the second bit from the right of "0011". The last pixel data value of the seventh pixel for the gray level ⅓ is "1" of the first bit from the right of "0010". The last pixel data value of the eighth pixel for the gray level ¼ is "0" of the $0^{th}$ bit from the right of "0010".

The output relation of the pixel data for the ninth through twelfth pixels in the third line is as follows.

The duty cycle values of the dithering pattern for the gray levels ⅕, 1/7, 6/7, and 4/5 stored in the dithering pattern register 40 are respectively "10000", "0000001", "0111111", and "11101". In the above Table 4, the output value of the modular 7-register counter 128 of the ninth through twelfth pixels in the third line is "6" (it is assumed that the counting value is increased by "1" whenever the pixel is changed). The output value of the modular 5-register counter 130 is "1" (it is assumed that the counting value is increased by "1" whenever the pixel is changed). Briefly, the data pattern value provided from the multiplexers shown in FIGS. 2A and 2B are four bits from the $1^{st}$ bit from the left in the duty cycles of the dithering patterns for the gray levels ⅕, and from the $6^{th}$ bit for the gray level 1/7. Thus, the data pattern value provided from the multiplexer for DP ⅕ 146 for the gray level ⅕ is "0000". The data pattern value provided from the multiplexer for DP 1/7 136 for the gray level 1/7 is "1000". The data pattern value provide from the multiplexer for DP 6/7 144 for the gray level 6/7 is "1011". The data pattern value provided from the multiplexer for DP 4/5 152 for the gray level 4/5 is "1101". The last pixel data value of the ninth pixel for the gray level ⅕ is "0" of the third bit value from the right of "0000". The last pixel data value of the tenth pixel for the gray level 1/7 is "0" of the second bit from the right of "1000". The last pixel data value of the eleventh pixel for the gray level 6/7 is "1" of the first bit from the right of "1011". The last pixel data value of the twelfth pixel for the gray level 4/5 is "1" of the $0^{th}$ bit from the right of "1101".

The output relation of the pixel data for the thirteenth through sixteenth pixels in the third line is as follows.

The duty cycle values of the dithering pattern for the gray levels 5/7, ¾, ⅔, and 3/5 stored in the dithering pattern register 40 are respectively "1101101", "0111", "011", and "01011". In the above Table 4, the output value of the modular 7-register counter 128 of the thirteenth through sixteenth pixels in the third line is "0" (it is assumed that the counting value is increased by "1" whenever the pixel is changed, and the counter 128 can count to "6"). The output value of the modular 5-register counter 130 is "2" (it is assumed that the counting value is increased by "1" whenever the pixel is changed). The output value of the modular 4-register counter 132 is "3" (it is assumed that the counting value is increased by "1" whenever the pixel is changed). The output value of the modular 3-register counter 134 is "1" (it is assumed that the counting value is increased by "1" whenever the pixel is changed). Briefly, the data pattern values provided from the multiplexers shown in FIGS. 2A and 2B are four bits from the $0^{th}$ bit from the left in the duty cycles of the dithering patterns for the gray level 5/7, from the $3^{rd}$ bit for the gray level 3/4, from the $1^{st}$ bit for the gray level 2/3, and from the $3^{rd}$ bit for the gray level 3/5. Thus, the data pattern value provided from the multiplexer for DP 5/7 142 for the gray level 5/7 is "1101". The data pattern value provided from the multiplexer for DP 3/4 158 for the gray level 3/4 is "1011". The data pattern value provided from the multiplexer for DP 2/3 162 for the gray level 2/3 is "1101". The data pattern value provided from the multiplexer for DP 3/5 150 for the gray level 3/5 is "0110." Thus, the last pixel data value of the thirteenth pixel for the gray level 5/7 is "1" of the third bit value from the right of "1101". The last pixel data value of the fourteenth pixel for the gray level 3/4 is "0" of the second bit from the right of "1011". The last pixel data value of the fifteenth pixel for the gray level 2/3 is "0" of the first bit from the right of "1101". The last pixel data value of the sixteenth pixel for the gray level 3/5 is "0" of the $0^{th}$ bit from the right of "0110".

Next, the output relation of the pixel data for the first through fourth pixels in the fourth line is as follows.

The duty cycle values of the dithering pattern for the gray levels 4/7, 1/2, 3/7, and 2/5 stored in the dithering pattern register 40 are respectively "0101011", "0110", "1010100", and "00110". In the Table 4, the output value of the modular 7-register counter 128 of the first through fourth pixels in the fourth line is "6" (it is assumed that the counter is reset whenever the line is changed, and the counting value is increased by "2"). The output value of the modular 5-register counter 130 is "1" (it is assumed that the counter is reset whenever the line is changed, and the counting value is increased by "2"). And the output value of the modular 4-register counter 132 is "2" (it is assumed that the counter is reset whenever the line is changed, and the counting value is increased by "2"). Briefly, the data pattern values provided from the multiplexers shown in FIGS. 2A and 2B are four bits from the $6^{th}$ bit from the left in the duty cycles of the dithering patterns for the gray level 4/7, from the $2^{nd}$ for the gray level 1/2, from the $6^{th}$ bit for the gray level 3/7, and from the $1^{st}$ bit for the gray level 2/5. Thus, the data pattern value for the gray level 4/7 provided from the multiplexer for DP 4/7 140 is "1010". The data pattern value provided from the multiplexer for DP 1/2 156 for the gray level 1/2 is "1001". The data pattern value provided from the multiplexer for DP 3/7 138 for the gray level 3/7 is "0101". The data pattern value provided from the multiplexer for DP 2/5 148 for the gray level 2/5 is "0110.

Thus, the last pixel data value of the first pixel for the gray level 4/7 is "1" of the third bit value from the right of "1010". The last pixel data value of the second pixel for the gray level 1/2 is "0" of the second bit from the right of "1001". The last pixel data value of the third pixel for the gray level 3/7 is "0" of the first bit from the right of "0101". The last pixel data value of the fourth pixel for the gray level 2/5 is "0" of the $0^{th}$ bit from the right of "0110".

The output relation of the pixel data for the fifth through eighth pixels in the fourth line is as follows.

The duty cycle values of the dithering patterns for the gray levels 1/3, 1/4, 1/5, and 1/7 stored in the dithering pattern register 40 are respectively "100", "1000", "10000", and "0000001". In the Table 4, the output value of the modular 7-register counter 128 of the fifth through eighth pixels in the fourth line is "0" (it is assumed that the counting value is increased by "1" whenever the pixel is changed, and the counter 128 can count to "6"). The output value of the modular 5-register counter 130 is "2" (it is assumed that the counting value is increased by "1" whenever the pixel is changed). The output value of the modular 4-register counter 132 is "3" (it is assumed that the counting value is increased by "1" whenever the pixel is changed). An output value of the modular 3-register counter 134 is "1" (it is assumed that the counting value is increased by "1" whenever the pixel is changed). Briefly, the data pattern values provided from the multiplexers shown in FIGS. 2A and 2B are four bits from the $1^{st}$ bit from the left in the duty cycles of the dithering patterns for the gray level 1/3, from the $3^{rd}$ bit for the gray level 1/4, from the $2^{nd}$ bit for the gray level 1/5, and from the $0^{th}$ bit for the gray level 1/7. Thus, the data pattern value provided from the multiplexer for DP 1/3 160 for the gray level 1/3 is "0010". The data pattern value provide from the multiplexer for DP 1/4 154 for the gray level 1/4 is "0100". The data pattern value provided from the multiplexer for DP 1/5 146 for the gray level 1/5 is "0001". The data pattern value provided from the multiplexer for DP 1/7 136 for the gray level 1/7 is "0000". Thus, the last pixel data value of the fifth pixel for the gray level 1/3 is "0" of the third bit value from the right of "0010". The last pixel data value of the sixth pixel for the gray level 1/4 is "1" of the second bit from the right of "0100". The last pixel data value of the seventh pixel for the gray level 1/5 is "0" of the first bit from the right of "0001". The last pixel data value of the eighth pixel for the gray level 1/7 is "0" of the $0^{th}$ bit from the right of "0000".

The output relation of the pixel data for the ninth through twelfth pixels in the fourth line is as follows.

The duty cycle values of the dithering pattern for the gray levels 6/7, 4/5, 5/7, and 3/4 stored in the dithering pattern register 40 are respectively "0111111", "11101", "1101101" and "0111". In the Table 4, the output value of the modular 7-register counter 128 of the ninth through twelfth pixels in the fourth line is "1" (it is assumed that the counting value is increased by "1" whenever the pixel is changed). An output value of the modular 5-register counter 130 is "3" (it is assumed that the counting value is increased by "1" whenever the pixel is increased). An output value of the modular 4-register counter 132 is "0" (it is assumed that the counting value is increased by "1", and the counter 132 can count to "3"). Briefly, the data pattern values provided from the multiplexers shown in FIGS. 2A and 2B are four bits from the $1^{st}$ bit from the left in the duty cycles of the dithering patterns for the gray level 6/7, from the $3^{rd}$ bit for the gray level 4/5, from the $1^{st}$ bit for the gray level 5/7, and from the $0^{th}$ bit for the gray level 3/4. Thus, the data pattern value provided from the multiplexer for DP 6/7 144 for the gray level 6/7 is "1111". The data pattern value provided from the multiplexer for DP 4/5 152 for the gray level 4/5 is "0111". The data pattern value provided from the multiplexer for DP 5/7 142 for the gray level 5/7 is "1011". The data pattern value provided from the multiplexer for DP 3/4 158 for the gray level 3/4 is "0111". Thus, the last pixel data value of the ninth pixel for the gray level 6/7 is "1" of the third bit value from the right of "1111". The last pixel data value of the tenth pixel for the gray level 4/5 is "1" of the second bit from the right of "0111". The last pixel data value of the eleventh pixel for the gray level 5/7 is "1" of the first bit from the right of "1011". The last pixel data value of the twelfth pixel for the gray level 3/4 is "1" of the $0^{th}$ bit from the right of "0111".

The output relation of the pixel data for the thirteenth through sixteenth pixels in the fourth line is as follows.

The duty cycle values of the dithering pattern for the gray levels 2/3, 3/5, 4/7, and 1/2 stored in the dithering pattern register 40 are respectively "011", "01011", "0101011", and "0110". In the Table 4, the output value of the modular 7-register counter 128 of the thirteenth through sixteenth pixels in the fourth line is "2" (it is assumed that the counting value is increased by "1" whenever the pixel is changed). The output value of the modular 5-register counter 130 is "4" (it is assumed that the counting value is increased by "1" whenever the pixel is changed). The output value of the modular 4-register counter 132 is "1" (it is assumed that the counting value is increased by "1" whenever the pixel is changed). The output value of the modular 3-register counter 134 is "0" (it is assumed that the counting value is increased by "1" whenever the pixel is changed, and the counter 134 can count to "2"). Briefly, the data pattern values provided from the multiplexers shown in FIGS. 2A and 2B are four bits from the $0^{th}$ bit from the left in the duty cycles of the dithering patterns for the gray level 2/3, from the $4^{th}$ bit for the gray level 3/5, from the $2^{nd}$ bit for the gray level 4/7, and from the $1^{st}$ bit for the gray level 1/2. Thus, the data pattern value provided from the multiplexer for DP 2/3 162 for the gray level 2/3 is "0110". The data pattern value provided from the multiplexer for DP 3/5 150 for the gray level 3/5 is "1010". The data pattern value provided from the multiplexer for DP 4/7 140 for the gray level 4/7 is "0101". The data pattern value provided from the multiplexer for DP 1/2 156 for the gray level 1/2 is "1100". Thus, the last pixel data value of the thirteenth pixel for the gray level 2/3 is "0" of the third bit value from the right of "0110". The last pixel data value of the fourteenth pixel for the gray level 3/5 is "0" of the second bit from the right of "1010". The last pixel data value of the fifteenth pixel for the gray level 4/7 is "0" of the first bit from the right of "0101". The last pixel data value of the sixteenth pixel for the gray level 1/2 is "0" of the $0^{th}$ bit from the right of "1100".

Next, the output relation of the pixel data for the first through fourth pixels in the fifth line is as follows.

The duty cycle values of the dithering pattern for the gray levels 3/7, 2/5, 1/3, and 1/4 stored in the dithering pattern register 40 are respectively "1010100", "00110", "100", and "1000". In the Table 4, the output value of the modular 7-register counter 128 of the first through fourth pixels in the fifth line is "1" (it is assumed that the counter which can count to "6" is reset whenever the line is changed, and counting value is increased by "2"). An output value of the modular 5-register counter 130 is "3" (it is assumed that the counter is reset whenever the line is changed, and counting value is increased by "2"). The output value of the modular 4-register counter 132 is "0" (it is assumed that the counter which can count to "3" is reset whenever the line is changed, and counting value is increased by "2"). The output value of the modular 3-register counter 134 is "2" (it is assumed that the counter is reset whenever the line is changed, and counting value is increased by "2"). Briefly, the data pattern values provided from the multiplexers shown in FIGS. 2A and 2B are four bits from the $1^{st}$ bit from the left in the duty cycles of the dithering patterns for the gray level 3/7, from the $3^{rd}$ bit for the gray level 2/5, from the $0^{th}$ bit for the gray level 1/3, and from the $2^{nd}$ bit for the gray level 1/4. Thus, the data pattern value for the gray level 3/7 provided from the multiplexer for DP 3/7 138 is "0101". The data pattern value provided from the multiplexer for DP 2/5 148 for the gray level 2/5 is "1000". The data pattern value provided from the multiplexer for DP 1/3 160 for the gray level 1/3 is "0100". The data pattern value provided from the multiplexer for DP 1/4 154 for the gray level 1/4 is "1000. Thus, the last pixel data value of the first pixel for the gray level 3/7 is "0" of the third bit value from the right of "0101". The last pixel data value of the second pixel for the gray level 2/5 is "0" of the second bit from the right of "1000". The last pixel data value of the third pixel for the gray level 1/3 is "0" of the first bit from the right of "0100". The last pixel data value of the fourth pixel for the gray level 1/4 is "0" of the $0^{th}$ bit from the right of "1000".

The output relation of the pixel data for the fifth through eighth pixels in the fifth line is as follows.

The duty cycle values of the dithering patterns for the gray levels 1/5, 1/7, 6/7, and 4/5 stored in the dithering pattern register 40 are respectively "10000", "0000001", "0111111", and "11101". In the Table 4, the output value of the modular 7-register counter 128 of the fifth through eighth pixels in the fifth line is "2" (it is assumed that the counting value is increased by "1" whenever the pixel is changed). The output value of the modular 5-register counter 130 is "4" (it is assumed that the counting value is increased by "1" whenever the pixel is changed). Briefly, the data pattern values provided from the multiplexers shown in FIGS. 2A and 2B are four bits from the $4^{th}$ bit from the left in the duty cycles of the dithering patterns for the gray level 1/5, from the $2^{nd}$ bit for the gray level 1/7, from the $2^{nd}$ bit for the gray level 6/7, and from the $4^{th}$ bit for the gray level 4/5. Thus, the data pattern value provided from the multiplexer for DP 1/5 146 for the gray level 1/5 is "0100". The data pattern value provide from the multiplexer for DP 1/7 136 for the gray level 1/7 is "0000". The data pattern value provided from the multiplexer for DP 6/7 144 for the gray level 6/7 is "1111". The data pattern value provided from the multiplexer for DP 4/5 152 for the gray level 4/5 is "111". Thus, the last pixel data value of the fifth pixel for the gray level 1/5 is "0" of the third bit value from the right of "0100". The last pixel data value of the sixth pixel for the gray level 1/7 is "0" of the second bit from the right of "0000". The last pixel data value of the seventh pixel for the gray level 6/7 is "1" of the first bit from the right of "1111". The last pixel data value of the eighth pixel for the gray level 4/5 is "1" of the $0^{th}$ bit from the right of "1111".

The output relation of the pixel data for the ninth through twelfth pixels in the fifth line is as follows.

The duty cycle values of the dithering pattern for the gray levels 5/7, 314, 2/3, and 3/5 stored in the dithering pattern register 40 are respectively "1101101", "0111", "011", and "01011". In the Table 4, the output value of the modular 7-register counter 128 of the ninth through twelfth pixels in the fifth line is "3" (it is assumed that the counting value is increased by "1" whenever the pixel is changed). The output value of the modular 5-register counter 130 is "0" (it is assumed that the counting value is increased by "1" whenever the pixel is increased, and the counter 130 can count to "4"). The output value of the modular 4-register counter 132 is "2" (it is assumed that the counting value is increased by "1" whenever the pixel is changed). Briefly, the data pattern values provided from the multiplexers shown in FIGS. 2A and 2B are four bits from the $3^{rd}$ bit from the left in the duty cycles of the dithering patterns for the gray level 5/7, from the $2^{nd}$ bit for the gray level 3/4, from the $1^{st}$ bit for the gray level 2/3, and from the $0^{th}$ bit for the gray level 3/5. Thus, the data pattern value provided from the multiplexer for DP 5/7 142 for the gray level 5/7 is "1101". The data pattern value provided from the multiplexer for DP 3/4 158 for the gray level 3/4 is "1101". The data pattern value provided from the multiplexer for DP ⅔ 162 for the gray level ⅔ is "1101". The data pattern value provided from the multiplexer for DP ⅗ 150 for the gray level ⅗ is "0101". Thus, the last pixel data value of the ninth pixel for the gray level ⅝ is "1" of the third bit value from the right of "1101". The last pixel data value of the tenth pixel for the gray level ¾ is "1" of the second bit from the right of "1101". The last pixel data value of the eleventh pixel for the gray level ⅔ is "0" of the first bit from the right of "1101". The last pixel data value of the twelfth pixel for the gray level ⅗ is "1" of the $0^{th}$ bit from the right of "0101".

The output relation of the pixel data for the thirteenth through sixteenth pixels in the fifth line is as follows.

The duty cycle values of the dithering pattern for the gray levels ⅘, ½, ⅗, and ⅖ stored in the dithering pattern register 40 are respectively "0101011", "0110", "1010100", and "00110". In the Table 4, the output value of the modular 7-register counter 128 of the thirteenth through sixteenth pixels in the fifth line is "4" (it is assumed that the counting value is increased by "1" whenever the pixel is changed). The output value of the modular 5-register counter 130 is "1" (it is assumed that the counting value is increased by "1" whenever the pixel is changed). The output value of the modular 4-register counter 132 is "3" (it is assumed that the counting value is increased by "1" whenever the pixel is changed). Briefly, the data pattern values provided from the multiplexers shown in FIGS. 2A and 2B are four bits from the $4^{th}$ bit from the left in the duty cycles of the dithering patterns for the gray level ⅘, from the $3^{rd}$ bit for the gray level ½, from the $4^{th}$ bit for the gray level ⅗, and from the $1^{st}$ bit for the gray level ⅖. Thus, the data pattern value provided from the multiplexer for DP ⅘ 140 for the gray level ⅘ is "0110". The data pattern value provided from the multiplexer for DP ½ 156 for the gray level ½ is "0011". The data pattern value provided from the multiplexer for DP ⅗ 138 for the gray level ⅗ is "1001". The data pattern value provided from the multiplexer for DP ⅖ 148 for the gray level ⅖ is "0110". Thus, the last pixel data value of the thirteenth pixel for the gray level ⅘ is "0" of the third bit value from the right of "0110". The last pixel data value of the fourteenth pixel for the gray level ½ is "0" of the second bit from the right of "0011". The last pixel data value of the fifteenth pixel for the gray level ⅗ is "0" of the first bit from the right of "1001". The last pixel data value of the sixteenth pixel for the gray level ⅖ is "0" of the $0^{th}$ bit from the right of "0110".

The foregoing output relation of the pixel data is summarized in Table 5 below:

TABLE 5

| | 1st Pixel | 2nd Pixel | 3rd Pixel | 4th Pixel | 5th Pixel | 6th Pixel | 7th Pixel | 8th Pixel | 9th Pixel | 10th Pixel | 11th Pixel | 12th Pixel | 13th Pixel | 14th Pixel | 15th Pixel | 16th Pixel |
|---|---|---|---|---|---|---|---|---|---|---|---|---|---|---|---|---|
| 1st Line | 0 | 1 | 0 | 1 | 1 | 0 | 1 | 0 | 1 | 1 | 0 | 0 | 0 | 0 | 1 | 1 |
| 2nd Line | 0 | 1 | 1 | 0 | 1 | 0 | 0 | 0 | 0 | 0 | 0 | 0 | 1 | 1 | 1 | 1 |
| 3rd Line | 1 | 0 | 1 | 0 | 0 | 0 | 1 | 0 | 0 | 0 | 1 | 1 | 1 | 0 | 0 | 0 |
| 4th Line | 1 | 0 | 0 | 0 | 0 | 1 | 0 | 0 | 1 | 1 | 1 | 1 | 0 | 0 | 0 | 0 |
| 5th Line | 0 | 0 | 0 | 0 | 0 | 0 | 1 | 1 | 1 | 1 | 0 | 1 | 0 | 0 | 0 | 0 |

To sum up, the dithering pattern register for the respective gray levels is formed using the same bit number as a denominator value. Thus, the number of flip-flops required for dithering the gray levels can be reduced, so that the physical (hardware) size of the dithering pattern register can be minimized.

Further, an overall power consumption for the chip can be minimized. For 16 gray levels employed in the foregoing first and second examples, a required number of the flip-flops is 73 (7×5+5×4+4×3+3×2), which is ¼ of the flip-flops required in the conventional mechanism. The duty cycle is spatially maintained in one line or one frame by varying the bit field through the modular register counter. Moreover, the dithering can be temporally performed by maintaining the duty cycle between the frames.

As described above, mechanism of the present invention where a size of the dithering pattern register which stores plural gray levels is minimized is applicable to a picture data output system including an LCD controller, so that the physical (hardware) cost and power consumption thereof are reduced.

Although the preferred embodiments of the present invention have been disclosed for illustrative purposes, those skilled in the art will appreciate that various modifications, additions and substitutions are possible, without departing from the scope and spirit of the invention as described in the accompanying claims.

What is claimed is:

1. A liquid crystal display (LCD) controller generating control signals for displaying, in response to pixel data, pictures on a liquid crystal panel having a plurality of pixels, the LCD controller comprising:

a dithering pattern register section, comprising a first, second, third, and fourth dithering pattern register each for storing binary data of a gray level having a denominator value, wherein the gray level of the binary data of each of the first, second, third, and fourth dithering pattern registers has a same bit number as the denominator value of its respective dithering pattern register;

modular register counters for performing a counting operation to determine a binary value of a most significant bit of the gray levels in response to a frame clock, a line clock, and a pixel clock;

multiplexers for generating data patterns for the gray levels in accordance with an output of the respective modular register counters; and a selection means for selecting and generating a corresponding bit of a data pattern corresponding to the pixel data provided on an LCD panel among the data patterns.

2. The LCD controller of claim 1, wherein the dithering pattern register section forms dithering patterns using the same bit number as the gray levels of the denominator values of the first, second, third, and fourth dithering pattern registers.

3. The LCD controller of claim 1, wherein the dithering pattern register section is programmed to store the binary data as much as duty cycles for the gray levels of the first, second, third, and fourth dithering pattern registers using predetermined numbers as the denominator values of the gray levels.

4. The LCD controller of claim 1, wherein each of the modular register counters comprises:

a modular frame counter for performing counting operation whenever a frame is changed in response to the frame clock;

a modular line counter for performing counting operation whenever a line of the frame is changed in response to the line clock;

a modular pixel counter for performing counting operation whenever a pixel of the line is changed in response to the pixel clock;

a next frame counter for generating a first update value to the modular frame counter in response to an output signal of the modular frame counter so that a current value in the modular frame counter is updated whenever the frame is changed;

a next line counter for generating a second update value in response to an output signal of the modular line counter;

a first multiplexer for selectively generating an initial value of the modular frame counter or the second update value provided from the next line counter to the modular line counter in response to a first selection signal;

a next pixel counter for generating a third update value whenever the pixel is changed in response to an output signal of the modular pixel counter; and a second multiplexer for selectively generating the initial value of the modular frame counter, an initial value of the modular line counter, or the third update value provided from the next pixel counter to the modular pixel counter in response to a second selection signal.

5. The LCD controller of claim 4, wherein the modular frame counter, the modular line counter, and the modular pixel counter perform the counting operations in synchronization with the frame clock, the line clock, and the pixel clock, respectively.

6. The LCD controller of claim 4, wherein the next frame counter increases the first update value whenever the frame is changed, the next line counter increases the second update value whenever the line is changed, and the next pixel counter increases the third update value whenever the pixel is changed.

7. The LCD controller of claim 1, wherein the modular frame counter, the modular line counter, and the modular pixel counter are initialized to a predetermined value whenever the frame is changed, the line is changed, and the pixel is changed, respectively.

8. A method for performing a dithering and frame rate control in a liquid crystal display (LCD) controller generating control signals for displaying, in response to pixel data, pictures on a liquid crystal panel having a plurality of pixels, the method comprising the steps of:

storing binary data of gray levels in a first, a second, a third, and a fourth dithering pattern register each register having a denominator value, wherein the gray levels of the binary data of each of the first, second, third, and fourth dithering pattern registers use a same bit number as the denominator values of their respective dithering pattern registers;

performing a counting operation to determine a binary value of a most significant bit of the respective gray levels;

generating data patterns for the gray levels based on the binary value of the most significant bit; and selecting and generating a corresponding bit of a data pattern corresponding to the pixel data.

9. The method of claim 8, wherein the step of performing the counting operation comprises the steps of:

performing a counting operation whenever a frame is changed in response to a frame clock;

performing a counting operation whenever a line of the frame is changed in response to a line clock;

performing a counting operation whenever a pixel of the line is changed in response to a pixel clock;

providing a first update value whenever the frame is changed to update a current value for the counting operation in response to the frame clock;

providing a second update value whenever the line is changed in response to a result of the counting operation in response to the line clock;

selectively providing an initial value for the counting operation in response to the frame clock or the second update value, to update a current value for the counting operation in response to the line clock;

providing a third update value in response to a result of the counting operation in response to the pixel clock whenever the pixel is changed; and selectively providing the initial value for the counting operation in response to the frame clock, an initial value for the counting operation in response to the line clock, or the third update value, to update a current value for the counting operation in response to the pixel clock.

10. The method of claim 9, wherein the counting operations are performed in synchronization with the frame, line, and pixel clocks.

11. The method of claim 9, wherein the first update value is increased whenever the frame is changed, the second update value is increased whenever the line is changed, and the third update value is increased whenever the pixel is changed.

12. The method of claim 9, wherein the initial value for the counting operation in response to the frame clock is initialized to a predetermined value whenever the frame is changed.

13. The method of claim 9, wherein the initial value for the counting operation in response to the line clock is initialized to a predetermined value whenever the line is changed.

14. The method of claim 9, wherein an initial value for the counting operation in response to the pixel clock is initialized to a predetermined value whenever the pixel is changed.

15. The LCD controller of claim 1, wherein the first dithering pattern register stores binary data of a gray level having a denominator value "7", the second dithering pattern register stores binary data of a gray level having a denominator value "5", the third dithering pattern register stores binary data of a gray level having a denominator value "4", and the fourth dithering pattern register stores binary data of a gray level having a denominator value "3".

* * * * *